US007520601B2

(12) United States Patent
Claes et al.

(10) Patent No.: US 7,520,601 B2
(45) Date of Patent: Apr. 21, 2009

(54) PRINTING OF RADIATION CURABLE INKS INTO A RADIATION CURABLE LIQUID LAYER

(75) Inventors: Roland Claes, Dendermonde (BE); Robert Janssens, Geel (BE)

(73) Assignee: Agfa Graphics, N.V., Mortsel (BE)

( * ) Notice: Subject to any disclaimer, the term of this patent is extended or adjusted under 35 U.S.C. 154(b) by 340 days.

(21) Appl. No.: 11/253,260

(22) Filed: Oct. 18, 2005

(65) Prior Publication Data

US 2006/0092254 A1 May 4, 2006

Related U.S. Application Data

(60) Provisional application No. 60/630,107, filed on Nov. 22, 2004.

(30) Foreign Application Priority Data

Oct. 29, 2004 (EP) ..... 04105394

(51) Int. Cl.
*B41J 2/01* (2006.01)

(52) U.S. Cl. ..... 347/102

(58) Field of Classification Search ..... 347/101–102, 347/105, 96
See application file for complete search history.

(56) References Cited

U.S. PATENT DOCUMENTS 2,303,376 A 12/1942 Gustave
4,857,630 A 8/1989 Kim
5,085,689 A 2/1992 Kast
5,196,502 A 3/1993 Turner
5,225,522 A 7/1993 Turner
5,258,064 A 11/1993 Colt
5,443,628 A 8/1995 Loria et al.
5,501,726 A * 3/1996 Yui et al. ..... 106/31.58
5,538,548 A 7/1996 Yamazaki
5,713,993 A 2/1998 Morris et al.
5,720,802 A 2/1998 Wong et al.
5,969,002 A 10/1999 Kijlstra et al.
6,511,156 B1 * 1/2003 Kazama et al. ..... 347/47

(Continued)

FOREIGN PATENT DOCUMENTS

DE 196 36 382 A1 3/1998

(Continued)

OTHER PUBLICATIONS

European Search Report in 04 10 5394 (Apr. 25, 2005).

(Continued)

*Primary Examiner*—Stephen D Meier
*Assistant Examiner*—Geoffrey Mruk
(74) *Attorney, Agent, or Firm*—Leydig, Voit & Mayer, Ltd.

(57) ABSTRACT

A printing process is disclosed for ink-jet printing a radiation curable image on a substrate (14). First a radiation curable liquid layer (12) is provided on at least a portion of the substrate (14). Radiation curable ink-jet ink droplets (10) are jetted into the radiation curable liquid layer (12) and the radiation curable liquid layer (12) containing the radiation curable ink-jet ink droplets (13) is then cured. The resolution of the radiation curable image is controlled by uniformly adjusting the thickness of the liquid layer (12) for the dotsize of the radiation curable ink-jet ink jetted onto the cured layer.

11 Claims, 1 Drawing Sheet

U.S. PATENT DOCUMENTS

| | | | | |
|---|---|---|---|---|
| 6,532,871 | B1 * | 3/2003 | Aurenty et al. | 101/465 |
| 6,550,905 | B1 | 4/2003 | Deckers | |
| 6,720,042 | B2 | 4/2004 | Ylitalo et al. | |
| 2003/0021961 | A1 | 1/2003 | Ylitalo et al. | |
| 2003/0083396 | A1 * | 5/2003 | Ylitalo et al. | 522/74 |
| 2004/0189772 | A1 * | 9/2004 | Arai | 347/102 |
| 2004/0201660 | A1 * | 10/2004 | Nishikawa et al. | 347/100 |

FOREIGN PATENT DOCUMENTS

| | | | |
|---|---|---|---|
| EP | 0 259 130 | A2 | 3/1988 |
| EP | 0 526 198 | A1 | 2/1991 |
| EP | 0 428 828 | A2 | 5/1991 |
| EP | 0 776 952 | A2 | 6/1997 |
| WO | WO 00/30856 | A1 | 6/2000 |
| WO | WO 03/074619 | A1 | 9/2003 |

OTHER PUBLICATIONS

Crivello, J.V. wt al.; Photoinitiators for Free Radical Cationic & Anionic Photopolymerization; vol. III, 2nd Edi.; pp. 287-294 (1998).

Mc Cutcheon; *Functional Materials*, North American Edition; Glen Rock, N.J.: Manufacturing Confectioner Publishing Co.; pp. 110-129 (1990).

* cited by examiner

PRINTING OF RADIATION CURABLE INKS INTO A RADIATION CURABLE LIQUID LAYER

CROSS-REFERENCE TO RELATED PATENT APPLICATIONS

This application claims the benefit of U.S. Provisional Application No. 60/630,107 filed Nov. 22, 2004, which is incorporated by reference. In addition, this application claims the benefit of European Application No. 04105394 filed Oct. 29, 2004, which is also incorporated by reference.

TECHNICAL FIELD

The present invention relates to the printing of radiation curable inks into a radiation curable liquid layer, more specifically to high-speed ink-jet printing exhibiting high image quality.

BACKGROUND ART

In ink-jet printing,tiny drops of ink fluid are projected directly onto an ink-receiver surface without physical contact between the printing device and the ink-receiver. The printing device stores the printing data electronically and controls a mechanism for ejecting the ink drops image-wise onto the ink-receiver. Printing can be accomplished by moving a print head across the ink-receiver or vice versa.

The ink fluids can be roughly divided into:

- water based, the drying mechanism involving absorbance, penetration and evaporation;
- oil based, the drying involving absorbance and penetration;
- solvent based, the drying mechanism involving penetration but primarily evaporation;
- hot melt or phase change, in which the ink is liquid at the ejection temperature but solid at room temperature and wherein drying is replaced by solidification;
- radiation curable, in which drying is replaced by polymerization.

Water based, oil based and solvent based inks are jetted on ink-receivers, which typically contain either one or more porous layers that imbibe the ink via capillary action, or one or more polymer layers that swell to absorb the ink. Hot melt and radiation curable inks are usually jetted on substantially non-absorbing ink-receivers. Hot melt inks are limited to thermally stable ink-receivers, while radiation curable inks can be jetted on a wide variety of ink-receivers.

The main problem of radiation curable inks is that the image quality tends to change with the selection of the ink-receiver. In particular, the spreading of an ink droplet on the ink-receiver is highly dependent on the type of ink-receiver chosen.

One method to obtain a consistent image quality with a wide variety of ink-receivers would be to adapt the ink-jet ink set each time to the chosen ink-receiver. However, changing inks in printer and print head is very time consuming and not really a viable solution for an industrial printing environment. Therefore, the general approach is to modify the surface chemistry either with a suitable surface layer coating or by pre-treatment, i.e. plasma or corona treatment.

Corona discharge treatment and plasma treatment increases the cost, complexity and maintenance of the equipment used to process the substrates. Substrates may contain significant impurities or irregularities that may interfere with the treatment of the substrate. Thus, it is desirable to avoid the plasma treatment process where possible.

The other possibility for using the same ink-jet ink set on different ink-receivers is the application of a surface layer prior to jetting the radiation curable ink-jet ink. Generally, radiation curable ink-jet ink is jetted onto a dry surface layer, or alternatively, radiation curable inks are all jetted on a liquid layer (i.e. without intermediate curing of the liquid layer), as for example in U.S. Pat. No. 6,720,042 (3M).

U.S. Pat. No. 6,720,042 (3M) discloses an article comprising:

a) a sheet having a primed surface portion; and b) a radiation cured ink-jetted image derived from an ink composition comprising at least 25 weight percent of at least one radiation curable monomer disposed on said primed surface portion;

wherein the article is durable for outdoor usage.

In so-called "wet-on-wet printing", a radiation curable ink droplet is deposited on a previously deposited, uncured radiation curable ink droplet or droplets which form a wet ink layer.

WO 03074619 A (DOTRIX & SERICOL) discloses a progressive dot printing ink-jet process comprising the steps of applying a first ink drop to a substrate and subsequently applying a second drop on to the first ink drop without intermediate solidification of the first ink drop, wherein the first and second ink drops have a different viscosity, surface tension or curing speed.

By printing wet-on-wet, the spreading of the second ink drop on the first ink drop can be well controlled, as it is also the case for a possible third and fourth ink drop. However, the spreading of the first ink drop on the substrate remains critical and is dependent on the surface properties of the substrate. Using colourless ink for the first ink drop can reduce this image quality problem. Suitable radiation curable inks, including a colourless ink, for wet-on-wet ink-jet printing are disclosed by U.S. Pat. No. 6,550,905 (DOTRIX).

At the exhibition DRUPA 2004 in Dusseldorf, Germany, the company Aellorra™ Digital presented an ink-jet printing process with a high viscous white wet layer, produced by jetting a UV-curable white ink, instead of a colourless wet layer. A second radiation curable ink was jetted on top of the white wet layer and the UV-curing was performed.

Another problem associated with radiation curable ink-jet printing is that images exhibit a poor gloss compared to solvent or aqueous based inks on an absorbing substrate. The amount of solids, i.e. the radiation curable compounds and colorants, deposited on an ink-receiver varies with the image information, resulting in a higher surface roughness and hence a reduced glossiness.

WO 0030856 (XAAR) discloses a method of ink-jet printing on a substrate, comprising the steps of forming a wet undercoat layer on the substrate; depositing onto the undercoat layer, whilst the undercoat layer remains wet, a pattern of wet ink droplets and subsequently transforming the undercoat layer and deposited ink droplets to a dry state.

WO 0030856 (XAAR) improves the print quality by varying the thickness of the undercoat inversely with the thickness of the ink, so that a flat print surface is achieved. Beside restrictions on the arrangements of print heads and the calculating power required to achieve the variation of thickness in accordance with the image to be printed, it is also difficult to avoid the spreading of undercoat layer from unprinted area's, i.e. full thickness of the undercoat layer, into the area's printed with 100% ink, i.e. zero thickness of undercoat layer, which results in less sharp images.

The spreading of ink droplets on a substrate largely defines the resolution that can be obtained. Although surface property modification by either coating or pre-treatment techniques has been widely employed, the exact nature of the ink-media interaction is not fully understood. Attempts are typically made to correlate the print quality to measurable surface parameters such as surface energy and surface roughness, but these parameters do not fully capture the behaviour of ink droplets on various media.

Therefore, it would be desirable to have a printing process wherein the resolution of an image can be accurately controlled on a wide variety of ink-receivers and whereby the image exhibits a high glossiness.

OBJECTS OF THE INVENTION

It is an object of the present invention to provide a printing process wherein the resolution of a printed image is accurately controlled on a wide variety of ink-receivers.

It is an another object of the present invention to provide a printing process delivering images exhibiting a high and uniform gloss.

These and other objects of the invention will become apparent from the description hereinafter.

SUMMARY OF THE INVENTION

It was surprisingly found that by providing a substrate with a radiation curable liquid layer and uniformly adjusting the thickness of this liquid layer, that ink-jet images of high quality could be produced on a wide variety of substrates.

Objects of the present invention are realized by a printing process for ink-jet printing a radiation curable image on a substrate comprising the steps of:

a) providing a radiation curable liquid layer on at least a portion of said substrate;

b) jetting a first radiation curable ink-jet ink droplet into said radiation curable liquid layer;

c) curing said radiation curable liquid layer containing said radiation curable ink-jet ink droplet, and characterized by jetting a second radiation curable ink-jet ink droplet onto said cured layer of step c) and by adjusting the thickness of said radiation curable liquid layer in order to control the resolution of said radiation curable image.

Further advantages and embodiments of the present invention will become apparent from the following description.

DEFINITIONS

Figure 1:
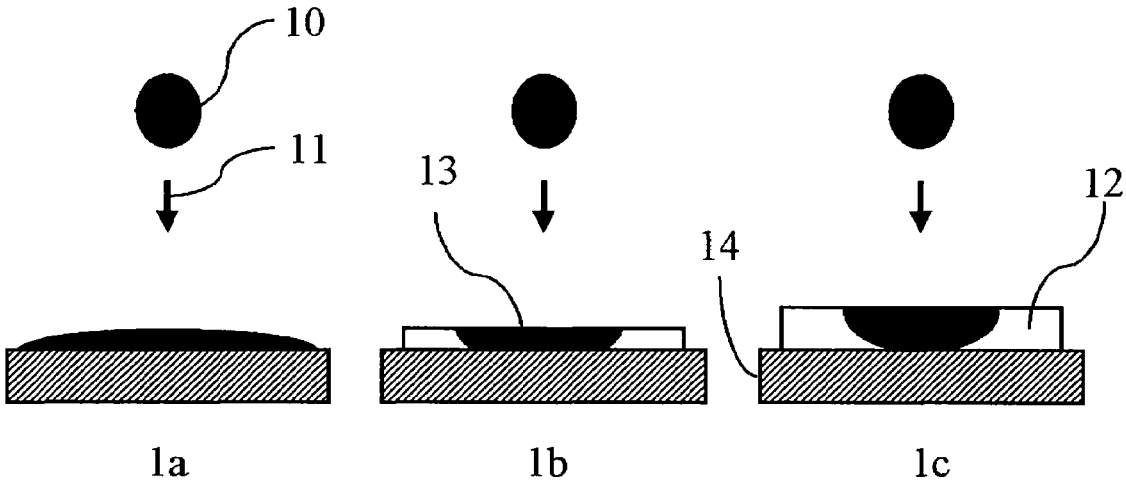
FIG. 1 is a schematic cross section through a substrate 14 printed in accordance with one aspect of the invention in 1*b* and 1*c*. In part 1a of FIG. 1, a radiation curable inkjet ink droplet 10 is jetted in the jetting direction 11 onto a substrate 14 exhibiting a large spreading. In part 1*b* of FIG. 1, the radiation curable inkjet ink droplet 10 is jetted into a radiation curable liquid layer 12, exhibiting a reduced dotsize. The thickness of the radiation curable liquid layer 12 is increased from 1*b* to 1*c*, which causes the dotsize of the radiation curable ink droplet 13 located in the liquid layer 12 to decrease further.

The term "actinic radiation" as used in disclosing the present invention, means electromagnetic radiation capable of initiating photochemical reactions.

The term "ultraviolet radiation" as used in disclosing the present invention, means electromagnetic radiation in the wavelength range of 4 to 400 nanometers.

The term "UV" is used in disclosing the present application as an abbreviation for ultraviolet radiation.

The term "Norrish Type I initiator" as used in disclosing the present invention, means a photo-initiator which cleaves after excitation, yielding the initiating radical immediately.

The term "Norrish type II-initiator" as used in disclosing the present invention, means a photo-initiator which is activated by actinic radiation and forms free radicals by hydrogen abstraction or electron extraction from a second compound that becomes the actual initiating free radical.

The term "co-initiator" as used in disclosing the present invention, means any molecule capable of transferring a hydrogen to the excited state of a Norrish type II-initiator and initiating the radical polymerization of a radiation curable composition.

The term "colorant", as used in disclosing the present invention, means dyes and pigments.

The term "dye", as used in disclosing the present invention, means a colorant having a solubility of 10 mg/L or more in the medium in which it is applied and under the ambient conditions pertaining.

The term "pigment" is defined in DIN 55943, herein incorporated by reference, as an inorganic or organic, chromatic or achromatic colouring agent that is practically insoluble in the application medium under the pertaining ambient conditions, hence having a solubility of less than 10 mg/L therein.

The term "alkyl" means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methylbutyl etc.

The term "acyl group" as used in disclosing the present invention means

—(C═O)-aryl and —(C═O)-alkyl groups.

The term "aliphatic group" as used in disclosing the present invention means saturated straight chain, branched chain and alicyclic hydrocarbon groups.

The term "aryl group" as used in disclosing the present invention means an assemblage of cyclic conjugated carbon atoms, which are characterized by large resonance energies, e.g. benzene, naphthalene and anthracene.

The term "alicyclic hydrocarbon group" means an assemblage of cyclic conjugated carbon atoms, which do not form an aromatic group, e.g. cyclohexane.

Printing Process

The printing process according to the present invention is a radiation curable inkjet printing process. The means for jetting may be one or more printing heads ejecting small droplets of ink in a controlled manner through nozzles towards an ink-receiver surface, which is moving relative to the printing head(s). The ejected or jetted ink forms an image on the ink-receiver. At high printing speeds, the inks must be ejected readily from the printing heads, which puts a number of constraints on the physical properties of the ink, e.g. a low viscosity at the jetting temperature, which may vary from 25 to 110° C., a surface energy such that the printing head nozzle can form the necessary small droplets, and a homogenous liquid capable of rapid conversion to a dry printed area.

A preferred ink-jet printing head for the printing process according to the present invention is a piezoelectric head. Piezoelectric ink-jet printing is based on the movement of a piezoelectric ceramic transducer when a voltage is applied thereto. The application of a voltage changes the shape of the piezoelectric ceramic transducer in the printing head creating a void, which is then filled with ink. When the voltage is again removed, the ceramic expands to its original shape, ejecting a drop of ink from the print head.

The ink-jet printing head is however not restricted to a piezoelectric ink-jet printing head. Other ink-jet printing heads for ink ejection can be used and include various types, such as a continuous type and thermal, electrostatic and acoustic drop on demand type.

For printing, an ink-jet printing head normally scans back and forth in a transversal direction across the moving ink-receiver surface. Often the ink-jet print head does not print on the way back. Bi-directional printing is preferred for obtaining a high areal throughput. Particularly preferred, is printing in a "single pass printing process", which can be performed by using page wide ink-jet printing heads (e.g. a page wide printing head available from XAAR) or multiple staggered ink-jet printing heads which cover the entire width of the ink-receiver surface. In a single pass printing process the ink-jet printing heads usually remain stationary and the ink-receiver surface is transported under the ink-jet printing heads.

High areal throughput ink-jet printing according to this invention means that images should be printed at more than 50 $m^2$/hour, preferably at more than 100 $m^2$/hour, even more preferably at more than 200 $m^2$/hour and most preferably at more than 300 $m^2$/hour. The resolution should at least be 180 dpi, preferably at least 300 dpi. The ink-receiver used in the high areal throughput ink-jet printing system according to this invention has preferably a width of at least 240 mm, then requiring a printing speed of at least 35 m/min. More preferably the width of the ink-receiver is at least 300 mm, and particularly preferably the width of the ink-receiver is at least 500 mm.

Ink Receiver

The ink receiver suitable for the printing process according to the present invention is a substrate provided with a radiation curable liquid layer. In a preferred embodiment the substrate is provided with a radiation curable liquid layer on only a portion of its surface, i.e. that area intended to be imaged with radiation curable ink-jet ink. At least part of the radiation curable ink forming the image is jetted into the radiation curable liquid layer. The radiation curable liquid layer may be applied to the substrate by any means known to one skilled in the art, e.g. spraying, jetting, screen-printing and coating.

The substrate may be chosen from the group consisting of paper, coated paper, polyolefin coated paper, cardboard, wood, composite boards, plastic, coated plastic, canvas, textile, metal, glasses, plant fibre products, leather, magnetic materials and ceramics.

The substrate for the ink-receiver is preferably substantially non-absorbing. Suitable examples are a resin-coated paper, e.g. polyethylene-coated paper and polypropylene-coated paper, and polymeric substrates.

Suitable polymeric substrates include, for example, cellulose acetate propionate, cellulose acetate butyrate, polyesters such as polyethylene terephthalate (PET) and polyethylene naphthalate (PEN); oriented polystyrene (OPS); oriented nylon (ONy); polypropylene (PP), oriented polypropylene (OPP); polyvinyl chloride (PVC); and various polyamides, polycarbonates, polyimides, polyolefins, poly(vinylacetals), polyethers and polysulfonamides, opaque white polyesters and extrusion blends of polyethylene terephthalate and polypropylene. Acrylic resins, phenol resins, glass and metals may also be used as a substrate. Other suitable substrate materials can be found in Modern Approaches to Wettability: Theory and Applications. Edited by SCHRADER, Malcolm E., et al. New York: Plenum Press, 1992. ISBN 0306439859.

The substrate can be transparent, translucent or opaque. The substrate may incorporate mineral particles as fillers, such as e.g. PET containing $CaCO_3$, PET containing $TiO_2$, a-PET and PET-g.

The substrate before printing may be coloured, e.g. a transparent PET containing a blue dye suitable for medical imaging may be used as an ink-receiver.

Polyester film substrates and especially polyethylene terephthalate are preferred for certain applications particularly types with excellent dimensional stability. When such a polyester is used as a substrate, a subbing layer may be employed to improve the bonding of the jetted ink layer to the substrate, if it constitutes together with the unsubbed substrate a substantially non-absorbing ink-receiver. Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

Uniformly adjusting the thickness of the radiation curable liquid layer allows to control the dot size of the ink droplets jetted into the radiation curable liquid layer and hence the resolution.

The thickness of the radiation curable liquid layer is adjusted so that the dotsize of the droplet in the liquid layer matches the dotsize of an ink droplet jetted after curing the liquid layer. It is considered that two dotsizes match each other when they differ by no more than 10% in diameter related to the smallest dotsize when jetted at equal dpd (droplets per dot). For example, two dots of 30 μm and 40 μm do not match because (40 μm-30 μm)/30 μm×100%=33%. On the other hand, two dots of 38 and 40 μm do match because they only differ 5% in diameter: (40 μm-38 μm)/38 μm×100%=5%.

Curing Means

In the printing process according to the present invention, the jetted curable ink creates an uncured printed image. The printed image is cured by exposing it to radiation or by electron beam curing. A preferred means of radiation curing is ultraviolet light.

The curing means may be arranged in combination with the print head of the ink-jet printer, travelling therewith so that ink droplets are exposed to curing radiation very shortly after having been printed into the liquid layer. In such an arrangement it can be difficult to provide a small enough radiation source connected to and travelling with the print head. Therefore, a static fixed radiation source may be employed, e.g. a source of curing UV radiation, connected to the radiation source by means of flexible radiation conductive means such as a fibre optic bundle or an internally reflective flexible tube.

Alternatively, the curing radiation may be supplied from a fixed source to the radiation head by an arrangement of mirrors including a mirror upon the radiation head.

The source of radiation arranged not to move with the print head, may also be an elongate radiation source extending transversely across the ink-receiver surface to be cured and adjacent the transverse path of the print head so that the subsequent rows of images formed by the print head are passed, stepwise or continually, beneath that radiation source.

In practical arrangement, it may be desirable to provide a plurality of print heads in relative close proximity in a printing station, for printing with different coloured inks to produce a multi-coloured image. In that case, each may have its own dedicated radiation source.

Any ultraviolet light source may be employed as a radiation source, such as, a high or low-pressure mercury lamp, a cold cathode tube, a black light, an ultraviolet LED, an ultraviolet laser, and a flashlight. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 400 nm to 320 nm

UV-B: 320 nm to 290 nm

UV-C: 290 nm to 100 nm.

Furthermore, it is possible to cure the printed image using two light sources of differing wavelength or illuminance. For example, the first UV source can be selected to be rich in UV-C, in particular in the range of 240 nm-200 nm. The second UV source can then be rich in UV-A, e.g. a gallium-doped lamp, or a different lamp high in both UV-A and UV-B. The use of two UV sources has been found to have advantages e.g. a fast curing speed.

It is known that differently coloured inks absorb UV radiation differently, i.e. they each absorb differently in each of the UV-A, UV-B and UV-C range. Having two curing lamps ensures complete curing of all the colours in a single pass.

For facilitating curing, the ink-jet printer often includes one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels can be maintained as low as 200 ppm, but are generally in the range of 2000 ppm to 20000 ppm.

In one embodiment, the radiation curable liquid layer and/or radiation curable ink-jet ink are based on cationic polymerization, since this type of polymerization does not suffer from oxygen inhibition.

In another embodiment, the radiation curable ink-jet ink is a cationic radiation curable ink-jet ink without an initiator, and the cationic initiator is contained in the radiation curable liquid layer Radiation Curable Liquid Layer A radiation-curable liquid layer suitable for the printing process according to the present invention contains at least a radiation-curable compound. The radiation-curable compound can be selected from monomers and/or oligomers that can be polymerized by a curing means of an inkjet printer.

The radiation-curable liquid layer may contain an initiator.

The radiation-curable liquid layer may further contain a colorant or a white pigment such as titanium oxide, although preferably the layer is a clear liquid layer.

The radiation-curable liquid layer may contain a polymerization inhibitor to restrain polymerization by heat or actinic radiation.

The radiation-curable liquid layer may further contain at least one resin in order to obtain a stable dispersion of the colorant in the inkjet ink.

The radiation-curable liquid layer preferably further contains at least one surfactant.

The radiation-curable liquid layer may further contain at least one solvent.

The radiation-curable liquid layer may further contain at least one biocide.

The radiation-curable liquid layer may have a thickness of about 0.1 μm, for example, if metal ink-receivers are used, but preferably a thickness of at least 1 μm is preferred.

Radiation Curable Ink-Jet Ink

A radiation-curable ink-jet ink suitable for the printing process according to the present invention contains at least two components: (i) a radiation-curable compound and (ii) a colorant (i.e. pigment or dye).

The radiation-curable compound can be selected from monomers and/or oligomers that can be polymerized by a curing means of an inkjet printer.

The radiation-curable ink-jet ink may contain an initiator.

The radiation-curable ink-jet ink may contain a polymerization inhibitor to restrain polymerization by heat or actinic radiation. It is preferred to add an inhibitor during preparation of the inkjet ink.

The radiation-curable ink-jet ink may further contain at least one resin in order to obtain a stable dispersion of the colorant in the inkjet ink.

The radiation-curable ink-jet ink preferably further contains at least one surfactant.

The radiation-curable ink-jet ink preferably further contains at least one solvent.

The radiation-curable ink-jet ink preferably further contains at least one biocide.

An inkjet printer generally uses a radiation-curable ink-jet ink set consisting of a plurality of radiation-curable inkjet inks.

Radiation-Curable Compounds

The radiation curable ink-jet ink and the radiation curable liquid layer contain monomers and/or oligomers, which are polymerized by the curing means of the inkjet printer. Monomers, oligomers or prepolymers may possess different degrees of functionality, and a mixture including combinations of mono-, di-, tri- and higher functionality monomers, oligomers and/or prepolymers may be used. These components are curable, typically photo-curable, e.g. UV curable, and should adhere to the ink-receiver surface after printing and serve to bind the colorant. A mixture of two or more monomers of the same functionality is preferred, with particularly preferred a mixture of two di-functional monomers.

The viscosity of the radiation curable ink-jet ink and the radiation curable liquid layer can be adjusted by varying the ratio between the monomers and oligomers.

Any method of conventional radical polymerization, photo-curing system using photo acid or photo base generator, or photo induction alternating copolymerization may be employed. In general, radical polymerization and cationic polymerization are preferred, and photo induction alternating copolymerization needing no initiator may also be employed. Furthermore, a hybrid system of combinations of these systems is also effective.

Cationic polymerization is superior in effectiveness due to lack of inhibition of the polymerization by oxygen, however it is slow and expensive. If cationic polymerization is used, it is preferred to use an epoxy compound together with an oxetane compound to increase the rate of polymerization. Radical polymerization is the preferred polymerization process.

Any polymerizable compound commonly known in the art may be employed. Particularly preferred for use as a radiation-curable compound in the radiation curable ink-jet ink and the radiation curable liquid layer, are monofunctional and/or polyfunctional acrylate monomers, oligomers or prepolymers, such as isoamyl acrylate, stearyl acrylate, lauryl acrylate, octyl acrylate, decyl acrylate, isoamylstyl acrylate, isostearyl acrylate, 2-ethylhexyl-diglycol acrylate, 2-hydroxybutyl acrylate, 2-acryloyloxyethylhexahydrophthalic acid, butoxyethyl acrylate, ethoxydiethylene glycol acrylate, methoxydiethylene glycol acrylate, methoxypolyethylene glycol acrylate, methoxypropylene glycol acrylate, phenoxyethyl acrylate, tetrahydrofurfuryl acrylate, isobornyl acrylate, 2-hydroxyethyl acrylate, 2-hydroxypropyl acrylate, 2-hydroxy-3-phenoxypropyl acrylate, vinyl ether acrylates such as described in U.S. Pat. No. 4,857,630 (DU PONT), 2-(vinyloxy)ethylacrylate, 2-acryloyloxyethylsuccinic acid, 2-acryloyxyethylphthalic acid, 2-acryloxyethyl-2-hydroxyethyl-phthalic acid, lactone modified flexible acrylate, and t-butylcyclohexyl acrylate, triethylene glycol diacrylate, tetraethylene glycol diacrylate, polyethylene glycol diacrylate, dipropylene glycol diacrylate, tripropylene glycol diacrylate, polypropylene glycol diacrylate, 1,4butanediol diacrylate, 1,6hexanediol diacrylate, 1,9nonanediol diacrylate, neopentyl glycol diacrylate, dimethylol-tricyclodecane diacrylate, bisphenol A EO (ethylene oxide) adduct diacrylate, bisphenol A PO (propylene oxide) adduct diacrylate, hydroxypivalate neopentyl glycol diacrylate, propoxylated neopentyl glycol diacrylate, alkoxylated dimethyloltricyclodecane diacrylate and polytetramethylene glycol diacrylate, trimethylolpropane triacrylate, EO modified trimethylolpropane triacrylate, tri(propylene glycol)triacrylate, caprolactone modified trimethylolpropane triacrylate, pentaerythritol triacrylate, pentaerithritol tetraacrylate, pentaerythritolethoxy tetraacrylate, dipentaerythritol hexaacrylate, ditrimethylolpropane tetraacrylate, glycerinpropoxy triacrylate, caprolactam modified dipentaerythritol hexaacrylate, N-vinylamide such as N-vinylcaprolactam or N-vinylformamide; or acrylamide or a substituted acrylamide such as acryloylmorpholine; and amino functionalized polyetheracrylates such as described in U.S. Pat. No. 5,196,502 (KODAK).

Furthermore, methacrylates corresponding to the above-mentioned acrylates may be used with these acrylates. Of the methacrylates, methoxypolyethylene glycol methacrylate, methoxytriethylene glycol methacrylate, 4-(vinyloxy)butylmethacrylate, vinyl ether acrylates such as described in U.S. Pat. No. 5,225,522 (KODAK), hydroxyethyl methacrylate, phenoxyethyl methacrylate, cyclohexyl methacrylate, tetraethylene glycol dimethacrylate, and polyethylene glycol dimethacrylate are preferred due to their relatively high sensitivity and higher adhesion to an ink-receiver surface.

Furthermore, the radiation curable ink-jet ink and the radiation curable liquid layer may also contain polymerizable oligomers. Examples of these polymerizable oligomers include epoxy acrylates, aliphatic urethane acrylates, aromatic urethane acrylates, polyester acrylates, and straight-chained acrylic oligomers.

Colorants

Colorants may be dyes, but are preferably pigments or a combination thereof. Organic and/or inorganic pigments may be used.

The pigment particles should be sufficiently small to permit free flow of the ink through the inkjet printing device, especially at the ejecting nozzles which usually have a diameter ranging from 10 μm to 50 μm. The particle size influences also the pigment dispersion stability. It is also desirable to use small particles for maximum colour strength. The particles of the pigment dispersed in the ink-jet ink should have a particle size of less than 10 μm, preferably less than 3 μm, and most preferably less than 1 μm. The average particle size of pigment particles is preferably 0.05 to 0.5 μm. Very fine dispersions of pigments and methods for their preparation are disclosed in e.g. EP 776952 A (KODAK), U.S. Pat. No. 5,538,548 (BROTHER), U.S. Pat. No. 5,443,628 (VIDEOJET SYSTEMS), EP 259130 A (OLIVETTI), U.S. Pat. No. 5,285,064 (EXTREL), EP 429828 A (CANON) and EP 526198 A (XEROX).

Suitable pigments include as red or magenta pigments: Pigment Red 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, 257, Pigment Violet 3, 19, 23, 29, 30, 37, 50, and 88; as blue or cyan pigments: Pigment Blue 1,15, 15:1, 15:2, 15:3, 15:4, 15:6, 16, 17-1, 22, 27, 28, 29, 36, and 60; as green pigments: Pigment green 7, 26, 36, and 50; as yellow pigments: Pigment Yellow 1, 3, 12, 13, 14, 17, 34, 35, 37, 55, 74, 81, 83, 93, 94, 95, 97, 108, 109, 110, 128, 137, 138, 139, 153, 154, 155, 157, 166, 167, 168, 177, 180, 185, and 193; as white pigment: Pigment White 6, 18, and 21.

Furthermore, the pigment may be chosen from those disclosed by HERBST, W, et al. Industrial Organic Pigments, Production, Properties, Applications. 2nd edition. VCH, 1997.

Most preferred pigments are Pigment Yellow 1, 3, 128, 109, 93, 17, 14, 10, 12, 13, 83, 65, 75, 74, 73, 138, 139, 154, 151, 180, 185; Pigment Red 122, 22, 23, 17, 210, 170, 188, 185, 146, 144, 176, 57:1, 184, 202, 206, 207; Pigment Blue 15:3, Pigment Blue 15:2, Pigment Blue 15:1, Pigment Blue 15:4, Pigment Blue 15:6, Pigment Blue 16 and Pigment Violet 19.

Carbon black is usually used as the colouring material in black ink. Suitable black pigment materials include carbon blacks such as Pigment Black 7 (e.g. Carbon Black MA8™ from MITSUBISHI CHEMICAL), Regal™ 400R, Mogul™ L, Elftex™ 320 from CABOT Co., or Carbon Black FW18, Special Black 250, Special Black 350, Special Black 550, Printex™ 25, Printex™ 35, Printex™ 55, Printex™ 90, Printex™ 150T from DEGUSSA. Additional examples of suitable pigments are disclosed in U.S. Pat. No. 5,225,522 (KODAK).

The pigment is present in the range of 0.1 to 10 wt %, preferably in the range 1 to 5 wt % based on the total weight of the radiation curable inkjet ink.

Dyes suitable for the radiation curable ink-jet ink include direct dyes, acidic dyes, basic dyes and reactive dyes.

Suitable direct dyes for the radiation curable ink-jet ink include:

- C.I. Direct Yellow 1, 4, 8, 11, 12, 24, 26, 27, 28, 33, 39, 44, 50, 58, 85, 86, 100, 110, 120, 132, 142, and 144
- C.I. Direct Red 1, 2, 4, 9, 11, 134, 17, 20, 23, 24, 28, 31, 33, 37, 39, 44, 47, 48, 51, 62, 63, 75, 79, 80, 81, 83, 89, 90, 94, 95, 99, 220, 224, 227 and 343
- C.I. Direct Blue 1, 2, 6, 8,1 5, 22, 25, 71, 76, 78, 80, 86, 87, 90, 98, 106, 108, 120, 123, 163, 165, 192, 193, 194, 195, 196, 199, 200, 201, 202, 203, 207, 236, and 237
- C.I. Direct Black 2, 3, 7, 17, 19, 22, 32, 38, 51, 56, 62, 71, 74, 75, 77, 105, 108, 112, 117, and 154

Suitable acidic dyes for the radiation curable ink-jet ink include:

- C.I. Acid Yellow 2, 3, 7, 17, 19, 23, 25, 20, 38, 42, 49, 59, 61, 72, and 99
- C.I. Acid Orange 56 and 64
- C.I. Acid Red 1, 8, 14, 18, 26, 32, 37, 42, 52, 57, 72, 74, 80, 87, 115, 119, 131, 133, 134, 143, 154, 186, 249, 254, and 256
- C.I. Acid Violet 11, 34, and 75
- C.I. Acid Blue 1, 7, 9, 29, 87, 126, 138, 171, 175, 183, 234, 236, and 249
- C.I. Acid Green 9, 12, 19, 27, and 41

C.I. Acid Black 1, 2, 7, 24, 26, 48, 52, 58, 60, 94, 107, 109, 110, 119, 131, and 155

Suitable reactive dyes for the radiation curable ink-jet ink include:

C.I. Reactive Yellow 1, 2, 3, 14, 15, 17, 37, 42, 76, 95, 168, and 175

C.I. Reactive Red 2, 6, 11, 21, 22, 23, 24, 33, 45, 111, 112, 114, 180, 218, 226, 228, and 235

C.I. Reactive Blue 7, 14, 15, 18, 19, 21, 25, 38, 49, 72, 77, 176, 203, 220, 230, and 235

C.I. Reactive Orange 5, 12, 13, 35, and 95

C.I. Reactive Brown 7, 11, 33, 37, and 46

C.I. Reactive Green 8 and 19

C.I. Reactive Violet 2, 4, 6, 8, 21, 22, and 25

C.I. Reactive Black 5, 8, 31, and 39

Suitable basic dyes for the radiation curable ink-jet ink include:

C.I. Basic Yellow 11, 14, 21, and 32

C.I. Basic Red 1, 2, 9, 12, and 13

C.I. Basic Violet 3, 7, and 14

C.I. Basic Blue 3, 9, 24, and 25

Dyes can only manifest the ideal colour in an appropriate range of pH value. Therefore, the radiation curable ink-jet ink preferably further comprises a pH buffer, such as potassium hydroxide (KOH).

Photo-Initiators

A catalyst called a photo-initiator typically initiates the polymerization reaction. The photo-initiator requires less energy to activate than the monomers and oligomers to form the polymer. The photo-initiator suitable for use in the radiation curable ink-jet ink and the radiation curable liquid layer may be a Norrish type I initiator, a Norrish type II initiator or a photo-acid generator.

The photo-initiator absorbs light and is responsible for the production of free radicals or cations. Free radicals or cations are high-energy species that induce polymerization of monomers, oligomers and polymers and with polyfunctional monomers and oligomers thereby also inducing cross-linking.

A preferred Norrish type I-initiator is selected from the group consisting of benzoinethers, benzil ketals, α,α-dialkoxyacetophenones, α-hydroxyalkylphenones, α-aminoalkylphenones, acylphosphine oxides, acylphosphine sulphides, α-haloketones, α-halosulfones and α-halophenylglyoxalates.

A preferred Norrish type II-initiator is selected from the group consisting of benzophenones, thioxanthones, 1,2-diketones and anthraquinones. A preferred co-initiator is selected from the group consisting of an aliphatic amine, an aromatic amine and a thiol. Tertiary amines, heterocyclic thiols and 4-dialkylamino-benzoic acid are particularly preferred as co-initiator. [0109] Suitable photo-initiators are disclosed in CRIVELLO, J. V., et al. VOLUME III: Photoinitiators for Free Radical Cationic & Anionic Photopolymerization. 2ndth edition. Edited by BRADLEY, G. London, UK: John Wiley and Sons Ltd, 1998. p.287-294.

Specific examples of photo-initiators may include, but are not limited to, the following compounds or combinations thereof: benzophenone and substituted benzophenones, 1-hydroxycyclohexyl phenyl ketone, thioxanthones such as isopropylthioxanthone, 2-hydroxy-2-methyl-1-phenylpropan-1-one, 2-benzyl-2-dimethylamino-(4-morpholinophenyl) butan-1-one, benzil dimethylketal, bis(2,6-dimethylbenzoyl)-2,4,4-trimethylpentylphosphine oxide, 2,4,6trimethylbenzoyldiphenylphosphine oxide, 2-methyl-1-[4-(methylthio)phenyl]-2-morpholinopropan-1-one, 2,2-dimethoxy-1,2-diphenylethan-1-one or 5,7-diiodo-3-butoxy-6-fluorone, diphenyliodonium fluoride and triphenylsulfonium hexafluophosphate.

Suitable commercial photo-initiators include Irgacure™ 184, Irgacure™ 500, Irgacure™ 907, Irgacure™ 369, Irgacure™ 1700, Irgacure™ 651, Irgacure™ 819, Irgacure™ 1000, Irgacure™ 1300, Irgacure™ 1870, Darocur™ 1173, Darocur™ 4265 and Darocur™ ITX available from CIBA SPECIALTY CHEMICALS, Lucerin TPO available from BASF AG, Esacure™ KT046, Esacure™ KIP150, Esacure™ KT37 and Esacure™ EDB available from LAMBERTI, H-Nu™ 470 and H-Nu™ 470X available from SPECTRA GROUP Ltd.

A preferred amount of initiator is 0.3-50 weight % of the total ink weight or of the total liquid layer weight, and more preferably 1-25 weight % of the total ink weight or of the total liquid layer weight.

Irradiation with actinic radiation may be realized in two steps by changing wavelength or intensity. In such cases it is preferred to use 2 types of initiator together.

Inhibitors

Suitable polymerization inhibitors include phenol type antioxidants, hindered amine light stabilizers, phosphor type antioxidants, hydroquinone monomethyl ether commonly used in (meth)acrylate monomers, and hydroquinone, t-butylcatechol, pyrogallol may also be used. Of these, a phenol compound having a double bond in molecules derived from acrylic acid is particularly preferred due to its having a polymerization-restraining effect even when heated in a closed, oxygen-free environment. Suitable inhibitors are, for example, Sumilizer™ GA-80, Sumilizer™ GM and Sumilizer™ GS produced by Sumitomo Chemical Co., Ltd, and Genorad™16, Genorad™18 available from Rahn of Zurich, Switzerland.

Since excessive addition of these polymerization inhibitors will lower the ink sensitivity to curing, it is preferred that the amount capable of preventing polymerization be determined prior to blending. The amount of a polymerization inhibitor is generally between 200 and 20,000 ppm of the total ink weight or the total liquid layer weight.

Resins

The radiation curable ink-jet ink and the radiation curable liquid layer may further contain a resin, also called a pigment stabilizer or dispersant used to obtain a stable dispersion of the pigment(s) in the inkjet ink.

The pigments may be added to the radiation curable ink-jet ink as a dispersion comprising a dispersant.

Suitable resins: petroleum type resins (e.g., styrene type, acryl type, polyester, polyurethane type, phenol type, butyral type, cellulose type, and rosin); and thermoplastic resins (e.g., vinyl chloride, vinylacetate type). Concrete examples of these resins include acrylate copolymers, styrene-acrylate copolymers, acetalized and incompletely saponified polyvinyl alcohol, and vinylacetate copolymers. Commercial resins are known under the tradenames Solsperse™ 32000 and Solsperse™ 39000 available from AVECIA, EFKA™ 4046 available from EFKA CHEMICALS BV, Disperbyk™ 168 available from BYK CHEMIE GmbH.

A detailed list of non-polymeric as well as some polymeric dispersants is disclosed by MC CUTCHEON. Functional Materials, North American Edition. Glen Rock, N.J.: Manufacturing Confectioner Publishing Co., 1990. p. 110-129.

Suitable pigment stabilizers are also disclosed in DE 19636382 (BAYER), U.S. Pat. No. 5720802 (XEROX), U.S.

Pat. No. 5713993 (DU PONT), PCT/GB95/02501, U.S. Pat. No. 5085689 (BASF) and U.S. Pat. No. 2303376 (FUJITSU ISOTEC).

Typically resins are incorporated at 2.5% to 200%, more preferably at 50% to 150% by weight of the pigment.

Surfactants

The radiation curable ink-jet ink and the radiation curable liquid layer may contain at least one surfactant. The surfactant(s) can be anionic, cationic, non-ionic, or zwitterionic and are usually added in a total quantity below 20 wt % based on the total ink weight, respectively the total liquid layer weight, and particularly in a total below 10 wt % based on the total ink weight, respectively the total liquid layer weight.

A fluorinated or silicone compound may be used as a surfactant, however, a potential drawback is extraction by food from inkjet food packaging material because the surfactant does not cross-link. It is therefore preferred to use a copolymerizable monomer having surface-active effects, for example, silicone-modified acrylates, silicone modified methacrylates, fluorinated acrylates, and fluorinated methacrylates.

Solvents

The radiation curable ink-jet ink and the radiation curable liquid layer may contain as a solvent, water and/or organic solvents, such as alcohols, fluorinated solvents and dipolar aprotic solvents, the solvent preferably being present in a concentration between 10 and 80 wt %, particularly preferably between 20 and 50 wt %, each based on the total weight of the radiation curable inkjet ink, respectively the total weight of the radiation curable liquid layer.

However, the radiation curable ink-jet ink preferably does not contain an evaporable component, but sometimes, it can be advantageous to incorporate an extremely small amount of an organic solvent in such inks to improve adhesion to the ink-receiver surface after UV curing. In this case, the added solvent can be any amount in the range which does not cause problems of solvent resistance and VOC, and preferably 0.1-5.0 wt %, and particularly preferably 0.1-3.0 wt %, each based on the total weight of the radiation curable ink-jet ink Suitable organic solvents include alcohol, aromatic hydrocarbons, ketones, esters, aliphatic hydrocarbons, higher fatty acids, carbitols, cellosolves, higher fatty acid esters. Suitable alcohols include, methanol, ethanol, propanol and 1-butanol, 1-pentanol, 2-butanol, t.-butanol. Suitable aromatic hydrocarbons include toluene, and xylene. Suitable ketones include methyl ethyl ketone, methyl isobutyl ketone, 2,4-pentanedione and hexafluoroacetone. Also glycol, glycolethers, N-methylpyrrolidone, N,N-dimethylacetamid, N,N-dimethylformamid may be used.

Biocides

Suitable biocides for the radiation curable ink-jet ink and the radiation curable liquid layer include sodium dehydroacetate, 2-phenoxyethanol, sodium benzoate, sodium pyridinethion-1-oxide, ethyl p-hydroxybenzoate and 1,2-benzisothiazolin-3-one and salts thereof. A preferred biocide for the radiation curable ink-jet ink and the radiation curable liquid layer is Proxel™ GXL available from ZENECA COLOURS.

A biocide is preferably added in an amount of 0.001 to 3 wt %, more preferably 0.01 to 1.00 wt. %, each based on the total weight of the radiation curable ink-jet ink or the radiation curable liquid layer.

Preparation of a Radiation Curable Ink-Jet Ink

A dispersion of colorant for use in the radiation curable ink-jet ink may be prepared by mixing, milling and dispersion of colorant and resin. Mixing apparatuses may include a pressure kneader, an open kneader, a planetary mixer, a dissolver, and a Dalton Universal Mixer. Suitable milling and dispersion apparatuses are a ball mill, a pearl mill, a colloid mill, a high-speed disperser, double rollers, a bead mill, a paint conditioner, and triple rollers. The dispersions may also be prepared using ultrasonic energy.

Many different types of materials may be used as milling media, such as glasses, ceramics, metals, and plastics. In a preferred embodiment, the grinding media can comprise particles, preferably substantially spherical in shape, e.g. beads consisting essentially of a polymeric resin or yttrium stabilized zirconium beads.

In the process of mixing, milling and dispersion, each process is performed with cooling to prevent build up of heat, and also as much as possible under light conditions in which UV-light has been substantially excluded.

If the radiation curable ink-jet ink contains more than one pigment, the colour ink may be prepared using separate dispersions for each pigment, or alternatively several pigments may be mixed and co-milled in preparing the dispersion.

The dispersion process can be carried out in a continuous, batch or semi-batch mode.

The preferred amounts and ratios of the ingredients of the mill grind will vary widely depending upon the specific materials and the intended applications. The contents of the milling mixture comprise the mill grind and the milling media.

The milling time can vary widely and depends upon the pigment, mechanical means and residence conditions selected, the initial and desired final particle size, etc. In the present invention pigment dispersions with an average particle size of less than 100 nm may be prepared.

After milling is completed, the milling media is separated from the milled particulate product (in either a dry or liquid dispersion form) using conventional separation techniques, such as by filtration, sieving through a mesh screen, and the like. Often the sieve is built into the mill, e.g. for a bead mill. The milled pigment concentrate is preferably separated from the milling media by filtration.

In general it is desirable to make the colour ink in the form of a concentrated mill grind, which is subsequently diluted to the appropriate concentration for use in the ink-jet printing system. This technique permits preparation of a greater quantity of pigmented ink from the equipment. The pigment dispersion for preparing a radiation curable ink-jet ink is preferably diluted using monomers and/or oligomers. By dilution, the ink is adjusted to the desired viscosity, color, hue, saturation density, and print area coverage for the particular application.

EXAMPLES

The present invention will now be described in detail by way of Examples hereinafter.

Measurement Methods

1. Dotsize

The dot size was determined with a Videomet system available from KASPAR WALTER GmbH, which has an accuracy of 1 μm.

2. Gloss

The gloss was measured at an angle of 60° with a REFO 60 available from Dr. Lange.

3. Coalescence

The ink receiver must be readily wetted so that there is no "puddling", i.e. coalescence of adjacent ink-droplets to form large drops on the surface of the ink receiver. An evaluation was then made in accordance with a criterion described below.

Criterion:

1=no coalescence

2=limited coalescence

3=coalescence

4=extensive coalescence

5=full coalescence

Materials

All materials used in the following examples were readily available from Aldrich Chemical Co. (Belgium) unless otherwise specified. The "water" used in the examples was deionized water. The following materials were used:

Pigments

Hostaperm™ Red E5B02 is a magenta pigment (Pigment Violet 19) available from CLARIANT Sunfast™ Blue 249-1284 is a cyan pigment (Pigment Blue 15:3) available from SUN CHEMICAL Radiation Sensitive Compounds DPGDA™ is a difunctional acrylate monomer available from UCB.

Craynor™ CN 501 is a monomer available from CRAY VALLEY.

Sartomer™ SR9003 is a difunctional acrylate monomer available from SARTOMER;

Craynor™ CN 386 is an amine modified acrylate synergist available from CRAY VALLEY.

Craynor™ CN 501 is an amine modified polyether acrylate oligomer available from CRAY VALLEY.

Irgacure™ 500 is a photo-initiator available from CIBA SPECIALTY CHEMICALS.

Irgacure™ 907 is a photo-initiator available from CIBA SPECIALTY CHEMICALS

Irgacure™ 1870 is a photo-initiator available from CIBA SPECIALTY CHEMICALS.

Darocur™ ITX is a photo-initiator available from CIBA SPECIALTY CHEMICALS.

Surfactants & Dispersants

Solsperse™ 32000 is a resin available from AVECIA.

Solsperse™ 5000 is a resin available from AVECIA.

Byk™-333 is a surfactant available from BYK CHEMIE GmbH.

Substrates

PE-paper is a poly(ethylene) coated unsubbed RC-paper available from FRANTSCHACH BELCOAT (Belgium).

PET is an unsubbed 175 μm thick polyethylene terephthalate substrate available from AGFA.

Example 1

This example illustrates how the dotsize of a ink droplet is controlled by the thickness.

Preparation of Radiation Curable Liquid Layer

A colourless radiation curable liquid layer composition Ink-L was prepared according to Table 1 by mixing the ingredients and stirring for one hour to ensure that all components were well distributed. The weight % (wt %) was based on the total weight of the radiation curable liquid layer composition.

TABLE 1

| wt % of: | Ink-L |
|---|---|
| DPGDA ™ | 66.5 |
| Irgacure ™ 907 | 2.5 |
| Darocur ™ ITX | 5.0 |
| Craynor ™ CN 501 | 25.0 |
| Byk ™-333 | 1.0 |

The radiation curable liquid layer composition INK-L was jetted on PET with a custom built ink-jet printer equipped with a UPH print head from AGFA to produce the ink receivers IR-2 to IR-7. A resolution of 360×360 dpi was used to print in a number of dpd (droplets per dot) as indicated by Table 2, wherein 1 dpd is equal to a droplet volume of 3 pL.

TABLE 2

| Ink receiver | # dpd of Liquid layer |
|---|---|
| IR-1 | 0 |
| IR-2 | 2 |
| IR-3 | 4 |
| IR-4 | 5 |
| IR-5 | 6 |
| IR-6 | 8 |
| IR-7 | 15 |

Preparation of Radiation Curable Ink-Jet Inks

The radiation curable ink-jet inks in this example consist of 100% solids, no solvents or water are used during the preparation of the ink composition. The radiation curable ink compositions Ink-M (Magenta ink) and Ink-C (Cyan ink) were prepared according to Table 3. The weight % (wt %) was based on the total ink weight.

TABLE 3

| wt % of: | Ink-M | Ink-C |
|---|---|---|
| Hostaperm ™ Red E5B02 | 5.00 | — |
| Sunfast ™ Blue 249-1284 | — | 2.00 |
| DPGDA ™ | 34.97 | 40.47 |
| Sartomer ™ SR9003 | 40.00 | 40.00 |
| Darocur ™ ITX | 5.00 | 5.00 |
| Craynor ™ CN 386 | 10.00 | 10.00 |
| Byk ™-333 | 0.03 | 0.03 |
| Solsperse ™ 32000 | 5.00 | 2.00 |
| Solsperse ™ 5000 | — | 0.50 |

First a concentrated dispersion was prepared of the colour pigments by mixing the pigment, the polymeric dispersant Solsperse™ 32000 and the monomer DPGDA™ with a dissolver and treating this mixture with an Eiger bead mill. For preparing Ink-C, a dispersant synergist Solsperse™ 5000 was used in combination with Solsperse™ 32000. The second monomer Sartomer™ SR9003, the synergist Craynor™ CN 386, the surfactant Byk™-333 and the photo-initiator Darocur™ ITX were added in this order under stirring to the concentrated pigment dispersion. Stirring was continued for one hour to ensure that all components were well distributed. A homogeneous ink composition was obtained.

Evaluation of the Properties

On the ink receivers IR-1 to IR-7, a 1 dpd of the radiation curable ink-jet inks INK-M and INK-C were jetted at a resolution of 360×360 dpi with the custom built ink-jet printer using a second UPH print head. The ink receivers were cured using a Fusion DRSE-120 conveyer, equipped with a Fusion VPS/1600 lamp (D-bulb), which transported the samples under the UV lamp on a conveyer belt at a speed of 20 m/min. The dotsize was determined for each cured sample.

TABLE 4

| Ink receiver | Dot diameter (μm) INK-M | Dot diameter (μm) INK-C |
|---|---|---|
| IR-1 | 82 | 80 |
| IR-2 | 64 | 68 |
| IR-3 | 50 | 52 |
| IR-4 | 44 | 44 |
| IR-5 | 40 | 44 |
| IR-6 | 30 | 30 |
| IR-7 | 30 | 30 |

Figure 2:
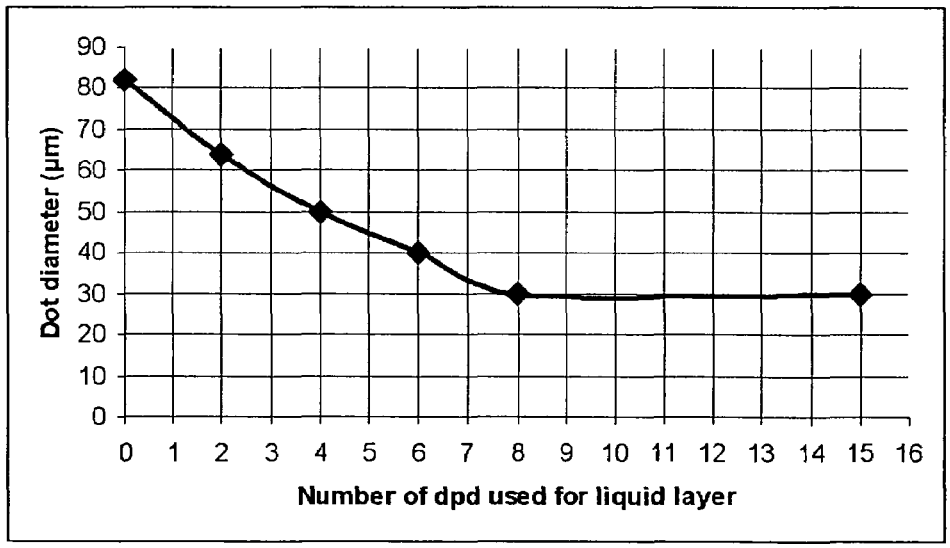
FIG. 2 is a graph depicting the relation between the thickness of the liquid layer and the dot diameter of a radiation curable ink droplet jetted into the liquid layer.

From Table 4 it is clear that the dot diameter of the jetted INK-M gradually decreases with an increasing thickness of the liquid layer on the ink receivers IR-1 to IR-6. At a thickness of 8 dpd or higher (15 dpd on IR-7), the dot diameter remains constant at 30 μm. The results are also represented in a graphical form by FIG. 2.

Instead of jetting, the radiation curable liquid layer composition INK-L was coated at a wet thickness of 5 μm on PE-paper using a bar coater and a wired bar. Then a 1 dpd of the radiation curable ink-jet inks INK-M and INK-C were jetted at a resolution of 360×360 dpi with the custom built ink-jet printer. The printed samples were cured using a Fusion DRSE-120 conveyer, equipped with a Fusion VPS/1600 lamp (D-bulb), which transported the printed samples under the UV lamp on a conveyer belt at a speed of 20 m/min. The dotsize was determined to be 30 μm for both ink-jet inks.

Example 2

In this example the dotsize of ink-jet inks jetted on the liquid layer after curing was evaluated.

An ink receiver IR-8 was prepared in the same manner as the ink receiver IR-7 of Example 1, except that the radiation curable ink-jet ink INK-M was used instead of INK-L. The ink receiver IR-5 of Example land the ink receiver IR-8 were first cured using a Fusion DRSE-120 conveyer, equipped with a Fusion VPS/1600 lamp (D-bulb), which transported the ink receivers under the UV lamp on a conveyer belt at a speed of 20 m/min.

On the cured ink receivers IR-5 and IR-8, 1 dpd of the radiation curable ink-jet inks INK-M and INK-C were jetted at a resolution of 360×360 dpi with the custom built ink-jet printer. The printed samples were cured by the same procedure as used for curing the ink receivers IR-5 and IR-8. The radiation curable ink INK-M was not jetted on the ink receiver IR-8 since visual differentiation would be difficult. The dotsize was determined for each cured sample.

TABLE 5

| Ink receiver | Dot diameter (μm) INK-M | Dot diameter (μm) INK-C |
|---|---|---|
| IR-5 | 46 | 44 |
| IR-8 | — | 42 |

Table 5 shows that in a dotsize between 42 and 46 μm is obtained by printing 1 dpd of the radiation curable ink-jet inks INK-M and INK-C on the cured ink receivers IR-5 and IR-8. In building an ink-jet printing system, it would desirable that a radiation curable ink jetted into the uncured liquid layer at 1 dpd would result in approximately the same dotsize as inks jetted at 1 dpd on the liquid layer after curing. From Table 3 and FIG. 2, it should be clear that the best choice in this case for the thickness of the radiation curable liquid layer is 5 dpd, i.e. ink receiver IR-4.

Example 3

In this example the coalescence and gloss was evaluated.

Preparation of Radiation Curable Liquid Layer

A colourless radiation curable liquid layer composition Ink-L2 was prepared according to Table 6 by mixing the ingredients and stirring for five minutes. The weight % (wt %) was based on the total weight of the radiation curable liquid layer composition.

TABLE 6

| Wt % of: | INK-L2 |
|---|---|
| Craynor ™ CN501 | 70.0 |
| Irgacure ™ 500 | 16.7 |
| Craynor ™ CN 386 | 8.3 |
| Irgacure ™ 1870 | 3.3 |
| Byk ™-333 | 1.7 |

Evaluation of the Properties

With the custom build printer equipped with a UPH head from AGFA the radiation curable liquid layer composition INK-L2 was jetted at 8 dpd and 360×360 dpi on half of the surface of a PET film. In a comparative sample COMP-1, the radiation curable inkjet ink INK-M was jetted onto the PET film, while in an inventive sample INV-1, the radiation curable inkjet ink INK-M was jetted into the liquid layer on the other half of the PET film. After UV-curing (Fusion VPS/1600 lamp (D-bulb) both samples, the coalescence was evaluated and the gloss was measured. The results are shown in Table 7.

TABLE 7

| Sample | Coalescence | Gloss | |
|---|---|---|---|
| | | Unprinted area | Area printed with INK-M |
| COMP-1 | 5 | 70% | 24% |
| INV-1 | 1 | 87% | 84% |

From Table 7 it is clear that no coalescence occurs for the inventive sample INV-1, contrary to the comparative sample COMP-1. Not only is for the inventive sample INV-1, the gloss of ink droplets jetted into the liquid layer much higher than the gloss of ink droplets jetted directly onto the PET (comparative sample COMP-1), but it is also comparable to the gloss of the liquid layer in an unprinted area. This results in a very good uniformity of the gloss in printed and unprinted areas.

Having described in detail preferred embodiments of the current invention, it will now be apparent to those skilled in the art that numerous modifications can be made therein without departing from the scope of the invention as defined in the following claims.

We claim:

1. A printing process for ink-jet printing a radiation curable image on a substrate comprising the steps of:

a) applying a radiation curable liquid layer of a uniform thickness on at least a portion of said substrate and in an area intended to be imaged with radiation curable ink-jet ink;

b) jetting a first radiation curable ink-jet ink droplet into said radiation curable liquid layer;

c) curing said radiation curable liquid layer containing said radiation curable ink-jet ink droplet; and d) jetting a second radiation curable ink-jet ink droplet onto said cured layer of step c), wherein the thickness of said radiation curable liquid layer is adjusted uniformly in order to control the resolution of said radiation curable image such that the dotsizes of said first and second radiation curable ink-jet inks do not differ by more than 10% in diameter relative to the smallest dotsize when jetted at equal dpd (droplets per dot).

2. The printing process according to claim 1, wherein in step a) said radiation curable liquid layer is applied on a portion of said substrate by ink-jet printing.

3. The printing process according to claim 1, wherein said radiation curable liquid layer is a clear liquid layer.

4. The printing process according to claim 1, wherein said radiation curable liquid layer is a white liquid layer.

5. The printing process according to claim 1, wherein in step a) said radiation curable liquid layer is provided on a portion of said substrate by ink-jet printing.

6. The printing process according to claim 1, wherein said radiation curable liquid layer is a clear liquid layer.

7. The printing process according to claim 1, wherein said radiation curable liquid layer is a white liquid layer.

8. The printing process according to claim 1, wherein said radiation curable liquid layer and/or said first radiation curable ink-jet ink is suited for cationic polymerization.

9. The printing process according to claim 8, wherein said first radiation curable ink-jet ink is a cationic radiation curable ink-jet ink without a cationic initiator.

10. The printing process according to claim 9, wherein a said radiation curable liquid layer further includes a cationic initiator.

11. The printing process according to claim 1, wherein a cationic initiator is present in said radiation curable liquid layer.

* * * * *